US011471904B2

(12) United States Patent
Rousseau et al.

(10) Patent No.: US 11,471,904 B2
(45) Date of Patent: Oct. 18, 2022

(54) DECORATION DEVICE FOR DISTRIBUTION SYSTEM, AND DISTRIBUTION SYSTEM INCLUDING SUCH A DECORATION DEVICE

(71) Applicant: Albea Services, Gennevilliers (FR)

(72) Inventors: Jean-Pierre Rousseau, Gennevilliers (FR); Laurent Pesqueux, Gennevilliers (FR); Quentin Maunoury, Gennevilliers (FR); Gael Thorez, Gennevilliers (FR)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 17/074,599

(22) Filed: Oct. 19, 2020

(65) Prior Publication Data

US 2021/0114049 A1 Apr. 22, 2021

(30) Foreign Application Priority Data

Oct. 17, 2019 (FR) ..... 1911620

(51) Int. Cl.
*B05B 11/00* (2006.01)
*B65D 83/38* (2006.01)

(52) U.S. Cl.
CPC ..... *B05B 11/3049* (2013.01); *B65D 83/38* (2013.01); *B65D 2203/02* (2013.01)

(58) Field of Classification Search
CPC . B05B 11/3049; B05B 11/3047; B65D 83/38; B65D 2203/02; G09F 3/0295; G09F 3/205
USPC ..... 222/321.7
See application file for complete search history.

(56) References Cited

U.S. PATENT DOCUMENTS

| | | | | |
|---|---|---|---|---|
| 3,776,413 | A | 12/1973 | Myer | |
| 6,905,049 | B1 | 6/2005 | Lambert | |
| 7,874,461 | B2 * | 1/2011 | Bae | B05B 11/3069 222/321.9 |
| 8,308,029 | B2 * | 11/2012 | Ki | B05B 11/3008 222/321.9 |
| 8,490,837 | B2 * | 7/2013 | Michaux | B05B 11/306 222/321.9 |
| 8,695,852 | B2 * | 4/2014 | Bertin | B65D 83/205 222/402.11 |
| 9,609,935 | B2 * | 4/2017 | Lee | B05B 11/3001 |
| 9,643,760 | B2 * | 5/2017 | Choi | B65D 51/32 |
| 10,232,393 | B2 * | 3/2019 | Dumont | B05B 11/3052 |
| 2008/0296309 | A1 | 12/2008 | Jourdin et al. | |
| 2010/0213159 | A1 | 8/2010 | Jourdin et al. | |

(Continued)

FOREIGN PATENT DOCUMENTS

FR 2907768 5/2008

*Primary Examiner* — Vishal Pancholi
(74) *Attorney, Agent, or Firm* — CRGO Global; Steven M. Greenberg

(57) ABSTRACT

The invention proposes a decoration device for a system for distributing a fluid product, including a fret, capable of being arranged around a neck of a reservoir, and capable of hiding distribution means, the device also including a decorative strip arranged around an outer face of a peripheral wall of the fret. The decoration device is characterized in that it includes means for axially blocking the strip with respect to the fret, and in that it includes means for rotationally blocking the strip with respect to the fret, the device having no adhesive means between the strip and the outer face of the peripheral wall.

16 Claims, 17 Drawing Sheets

(56) References Cited

U.S. PATENT DOCUMENTS

2017/0341096 A1* 11/2017 Thorez ..... B05B 11/3053
2020/0095025 A1* 3/2020 Thorez ..... B65D 47/00

* cited by examiner

[Fig.1]
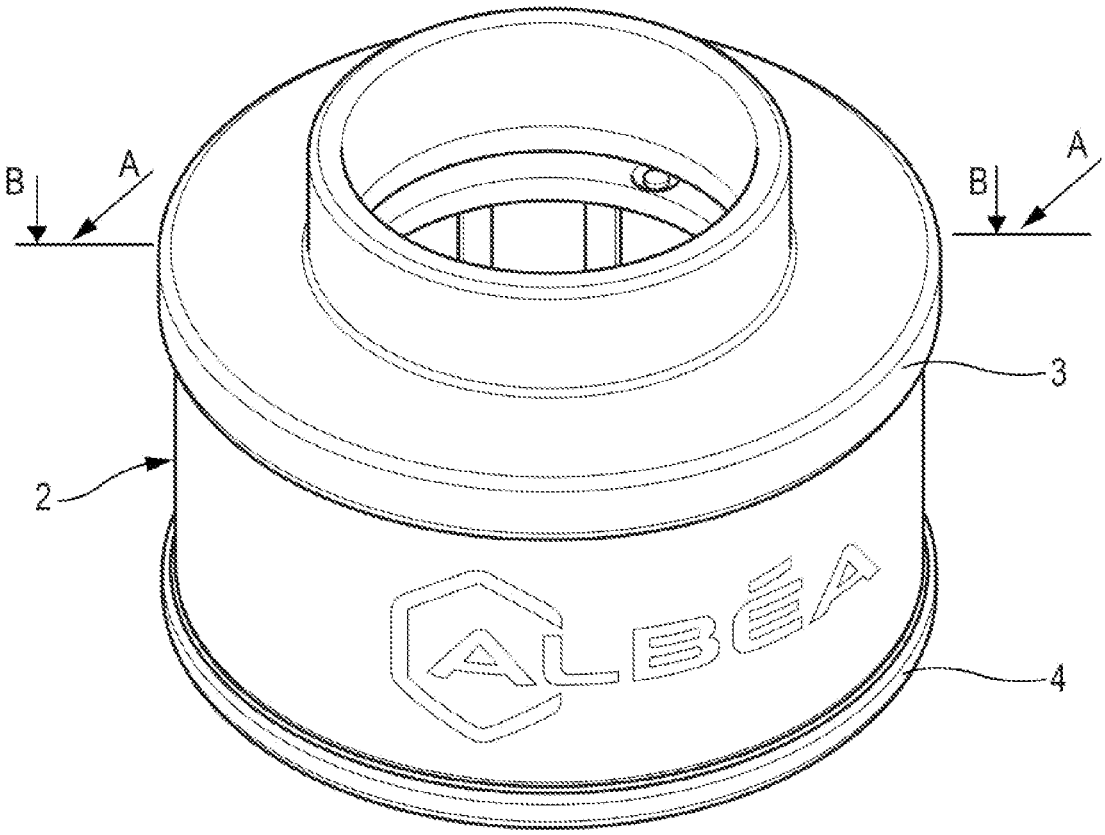

[Fig.2]
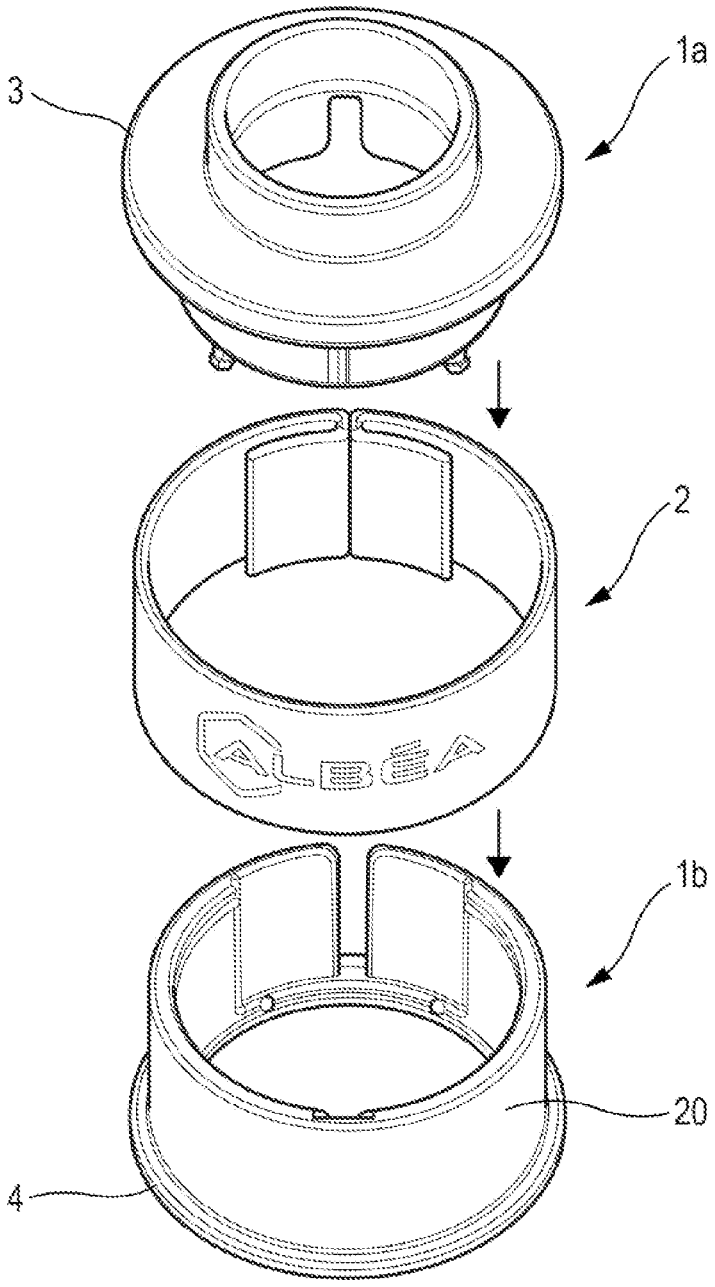

[Fig.3]
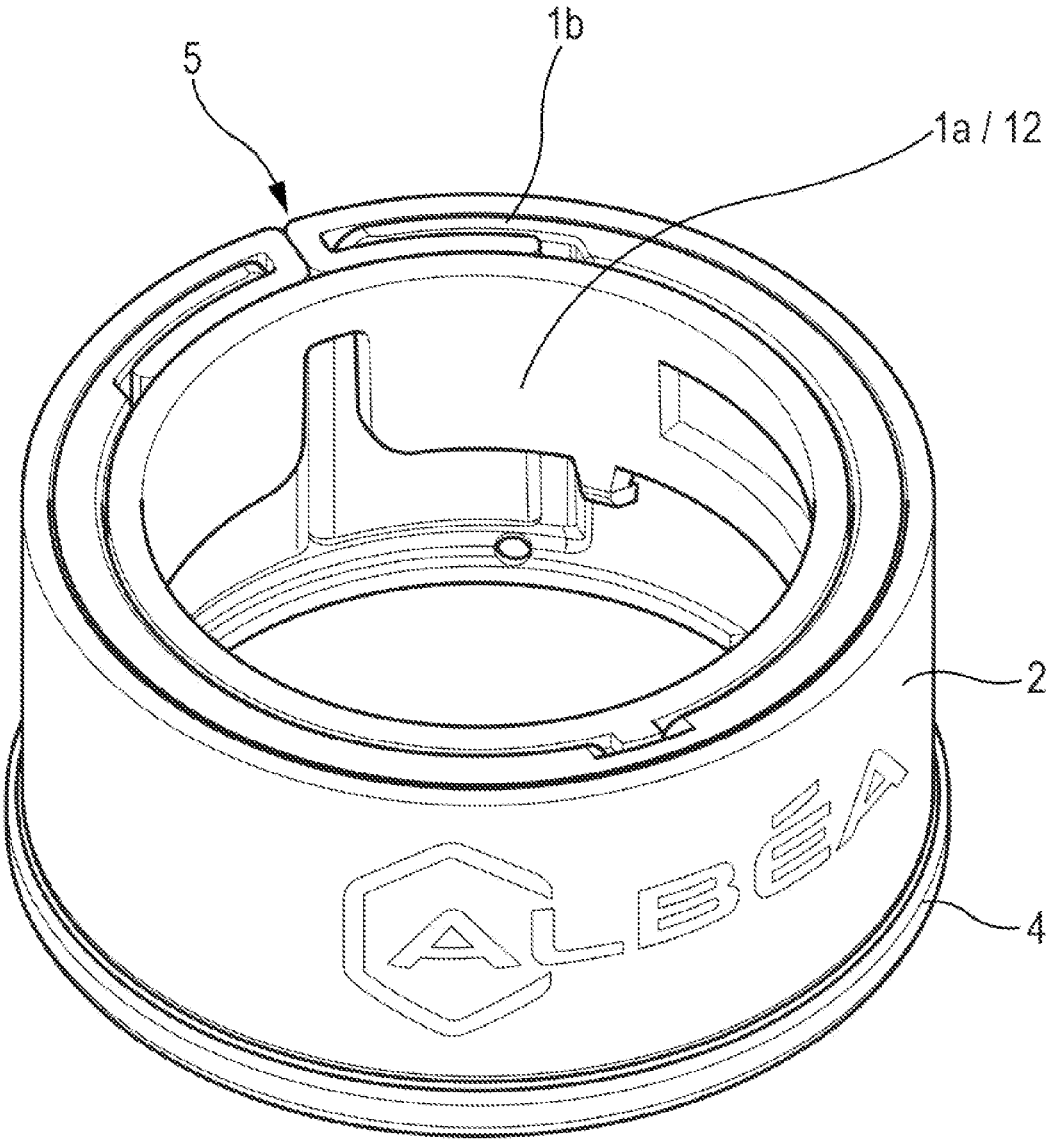
A-A

[Fig.4]
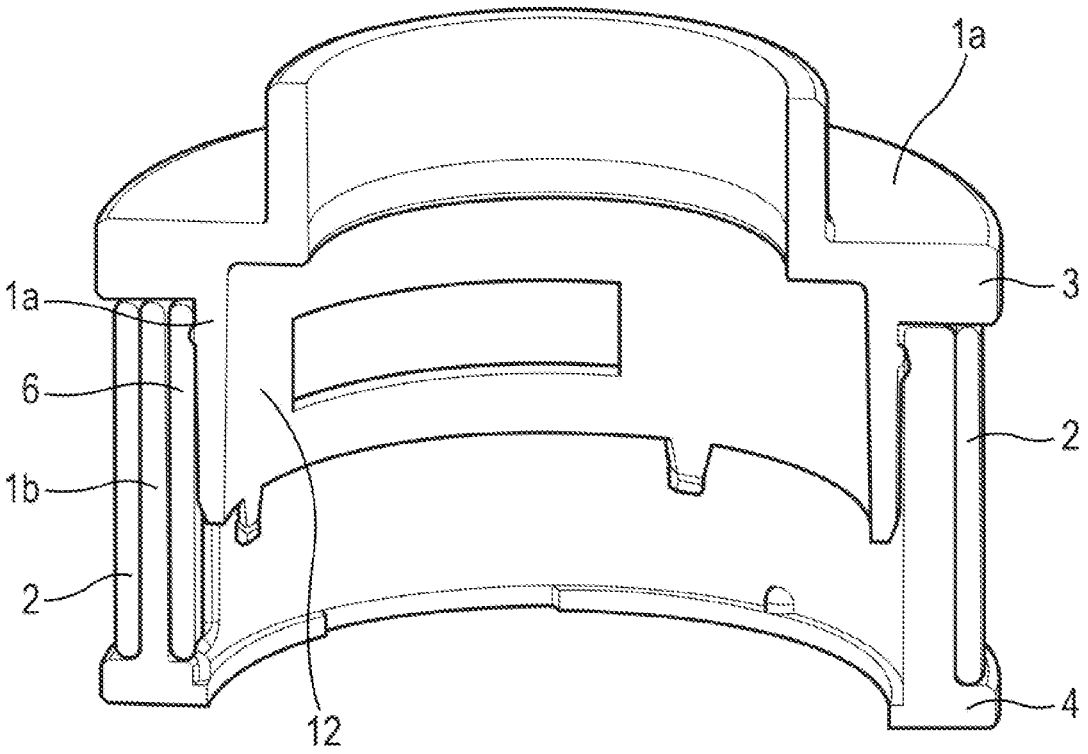

[Fig.5]
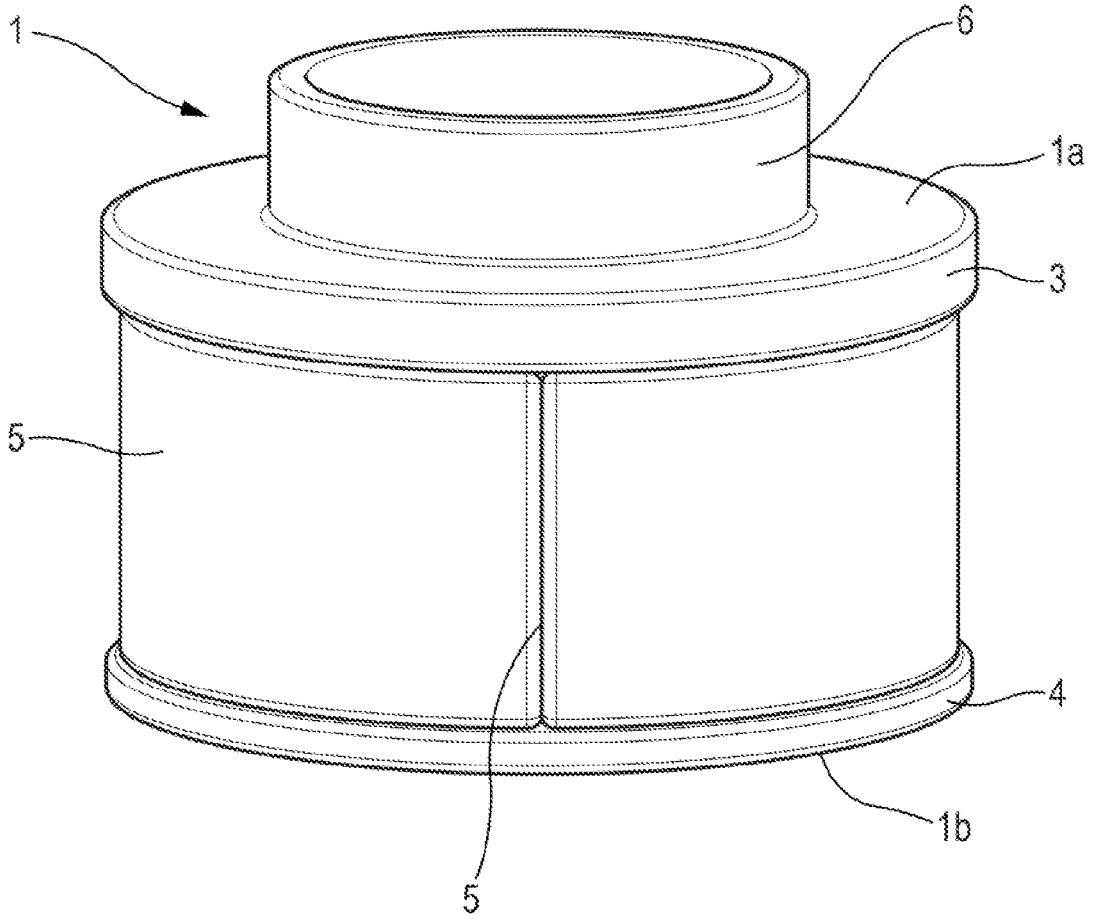

[Fig.6]
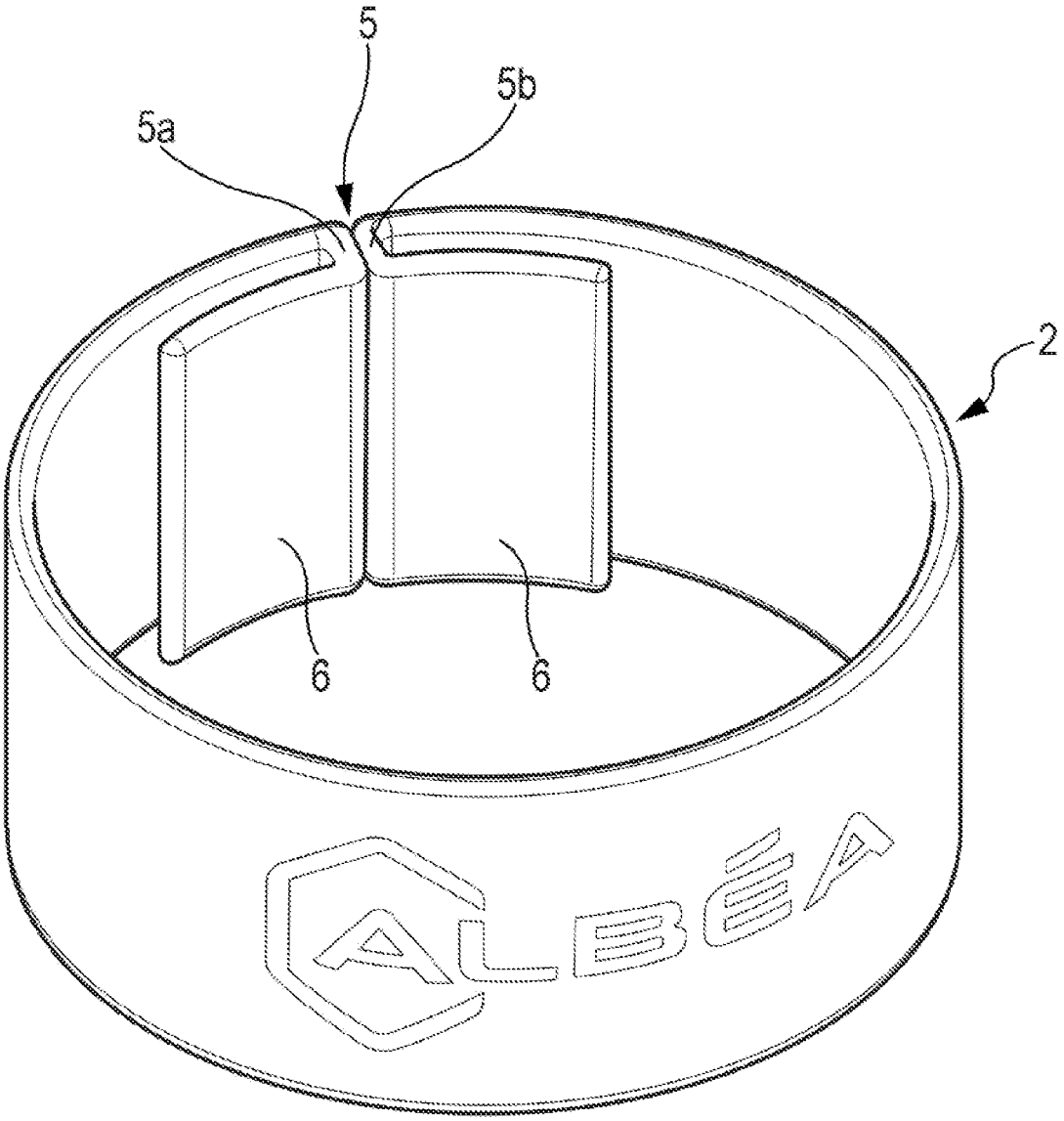

[Fig.7]
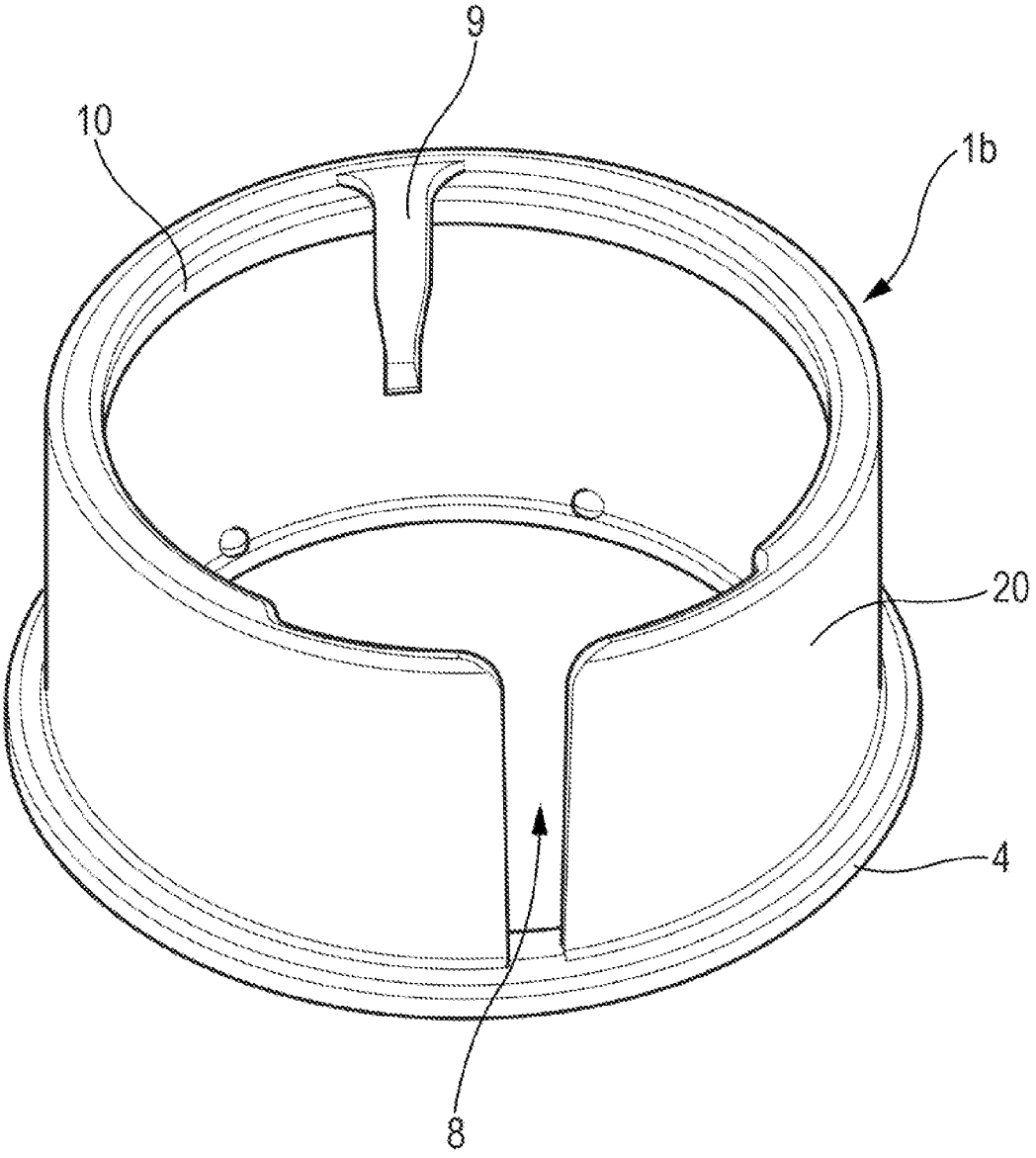

[Fig.8]
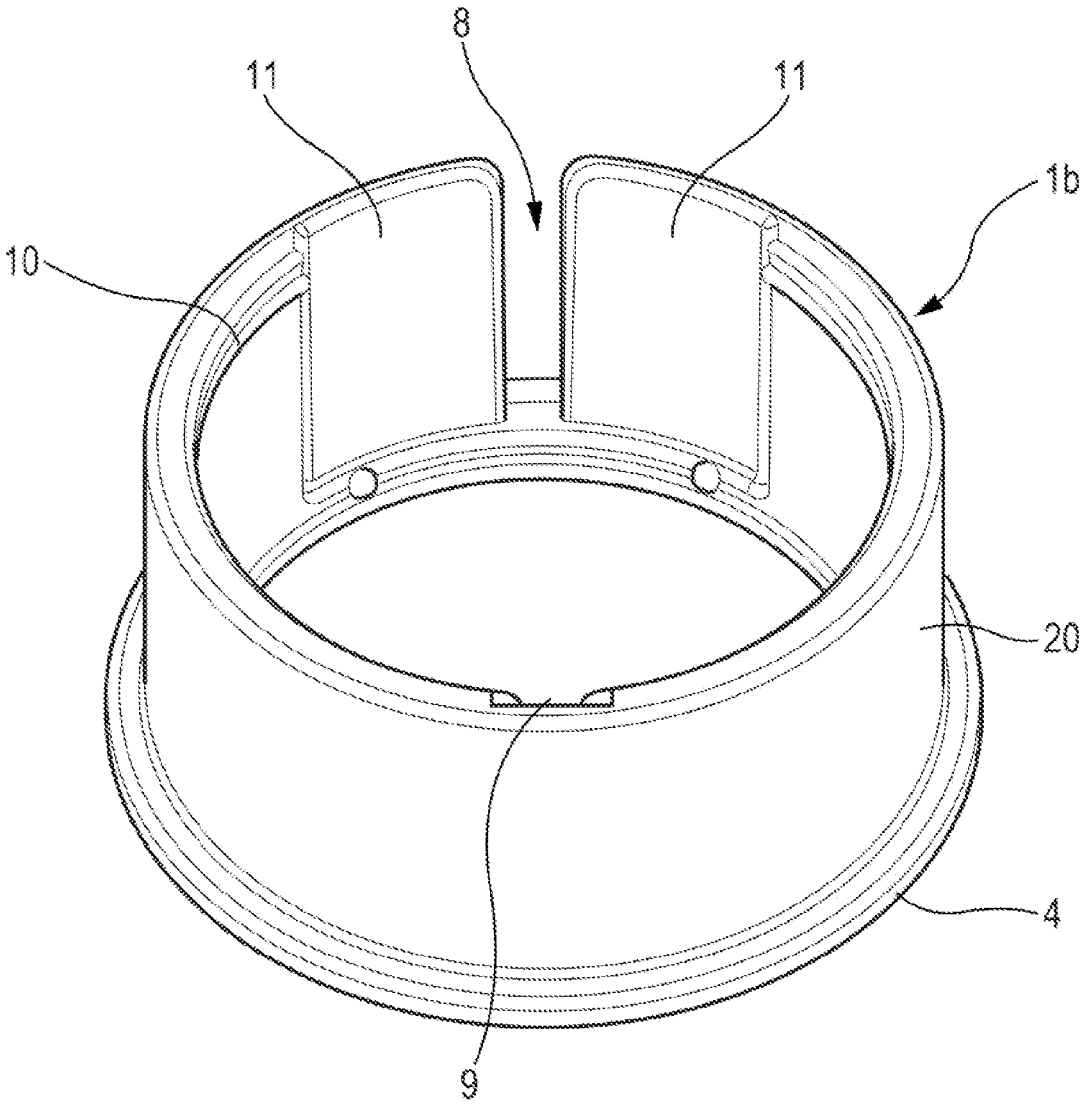

[Fig.9]
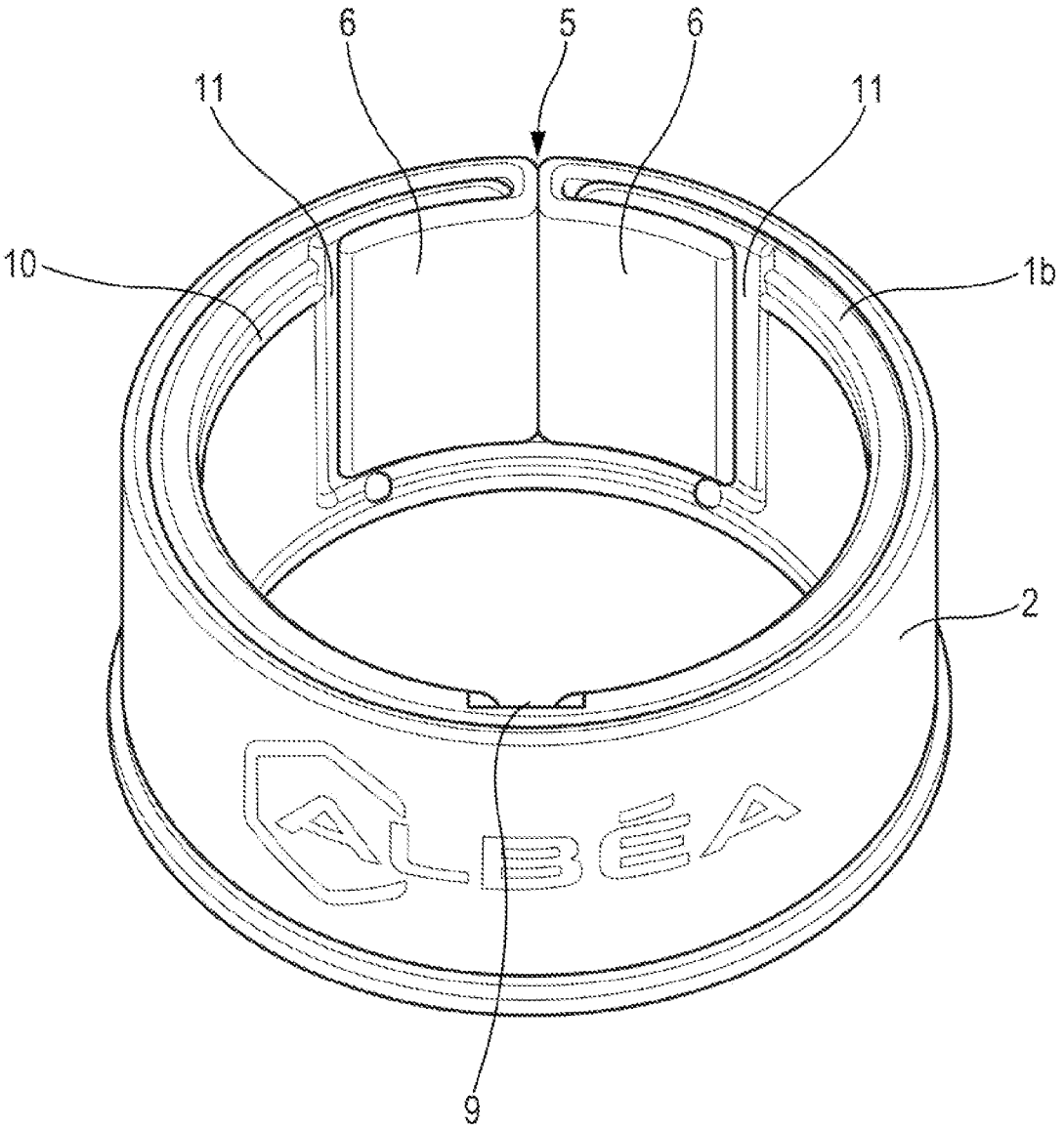

[Fig.10]
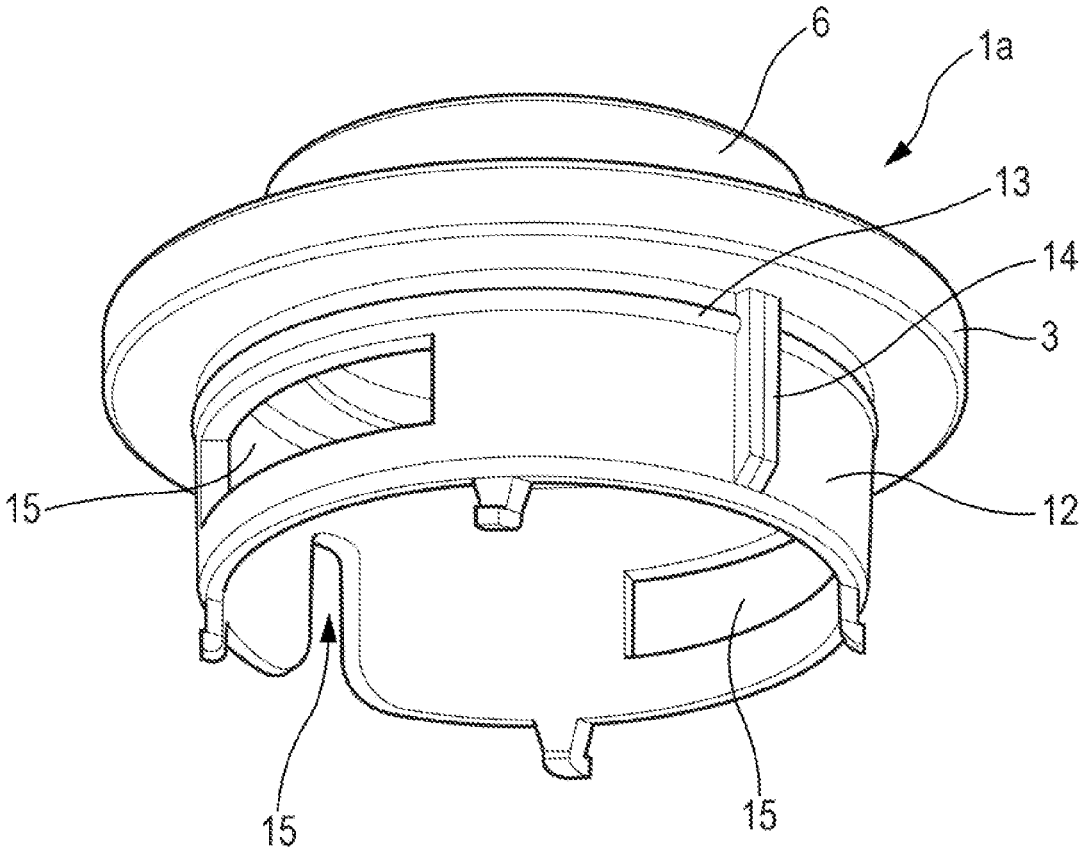

[Fig.11]
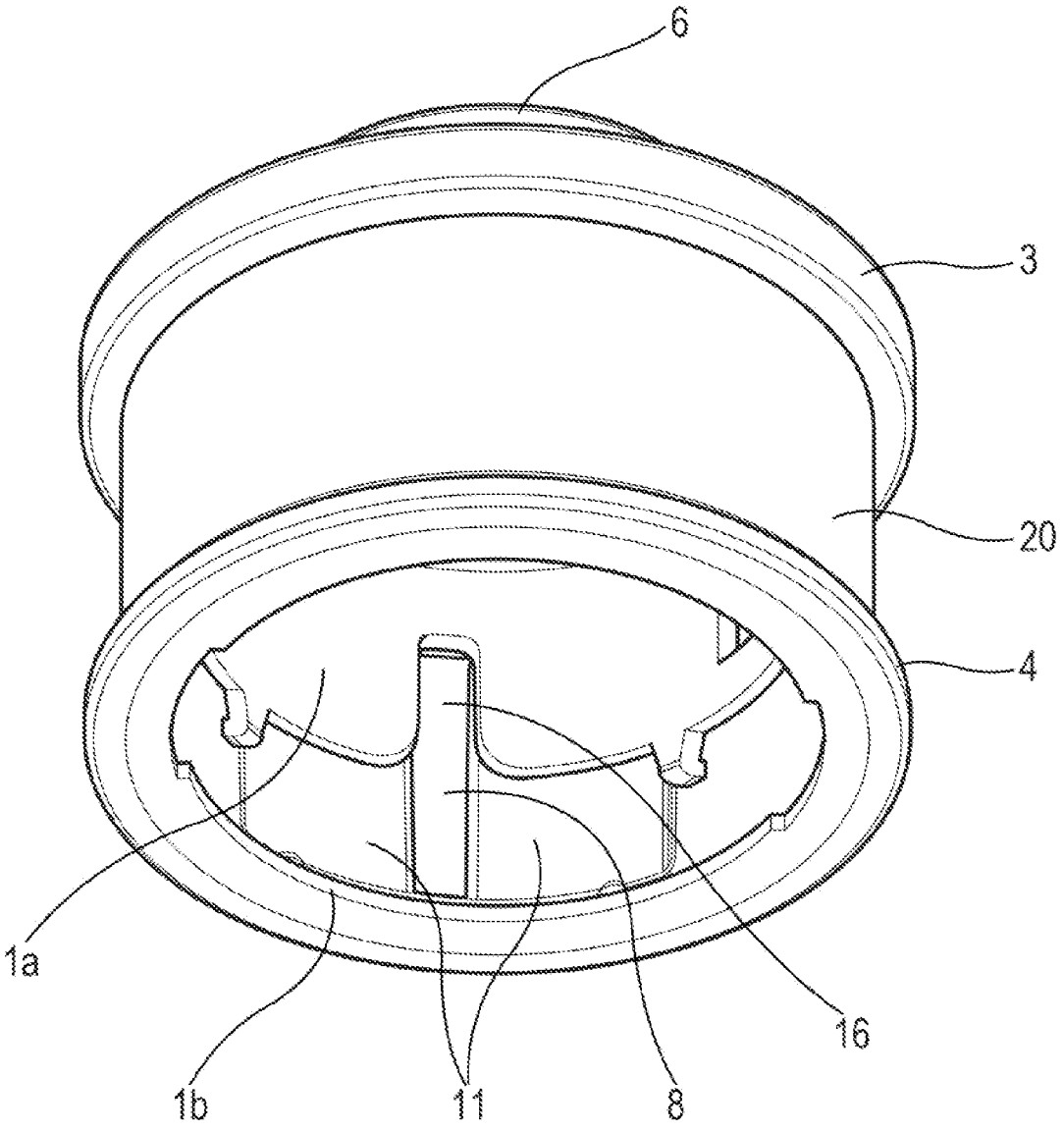

[Fig.12]
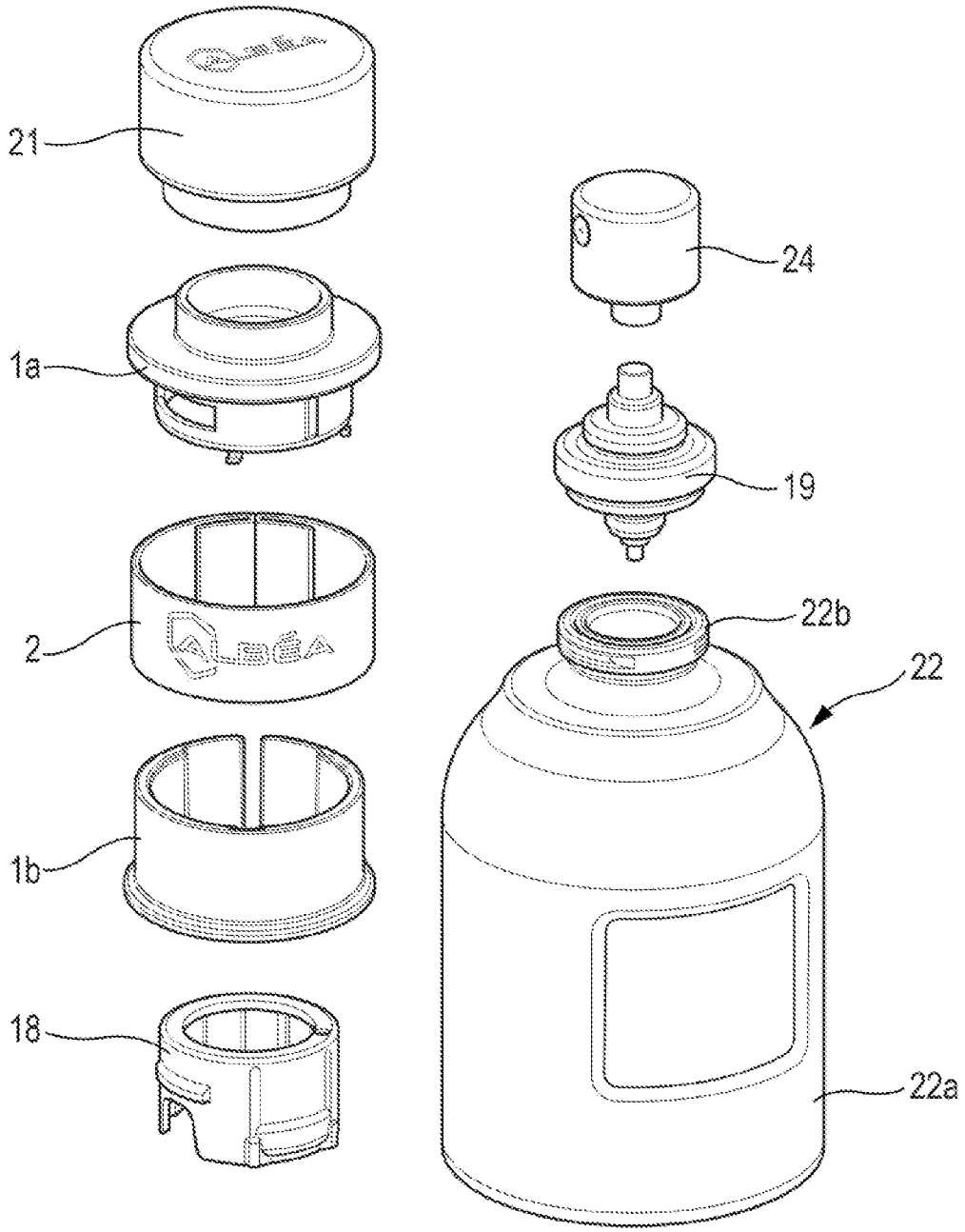

[Fig.13]
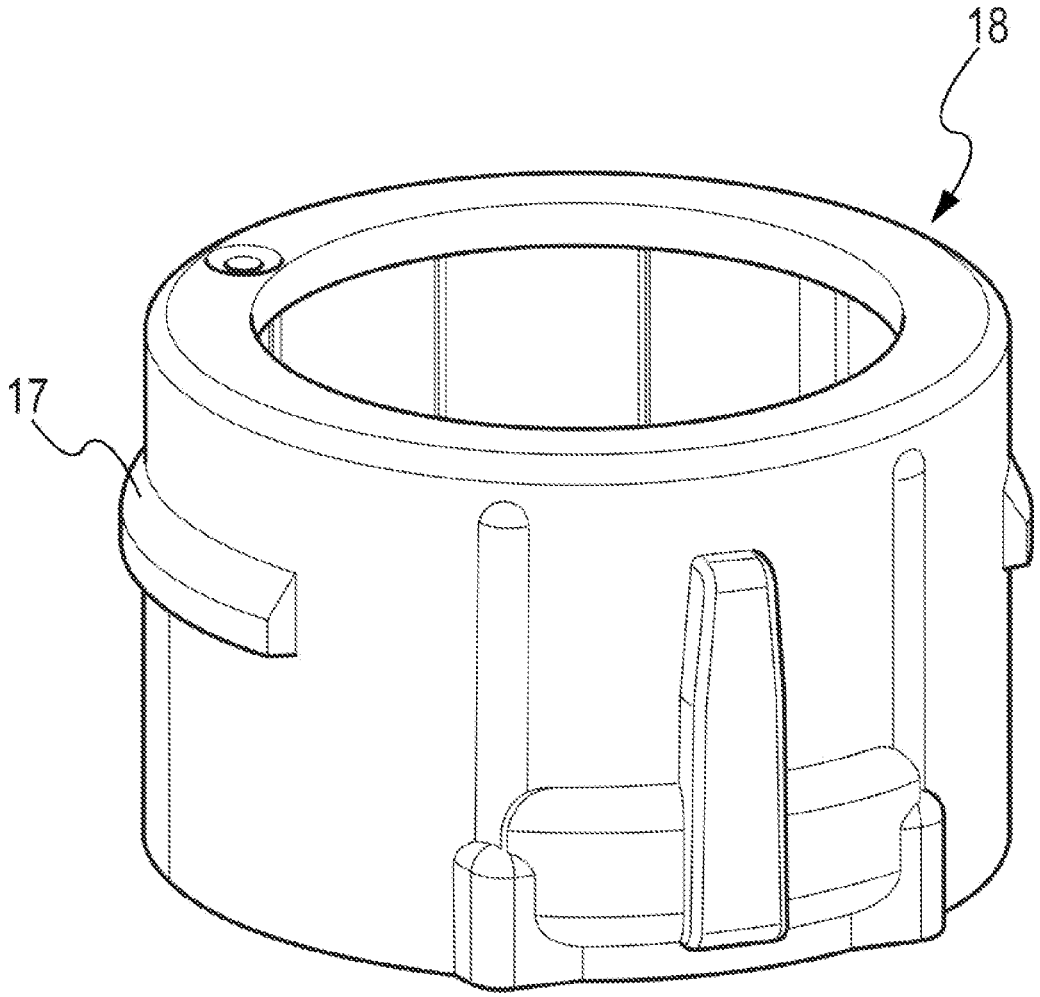

[Fig.14]
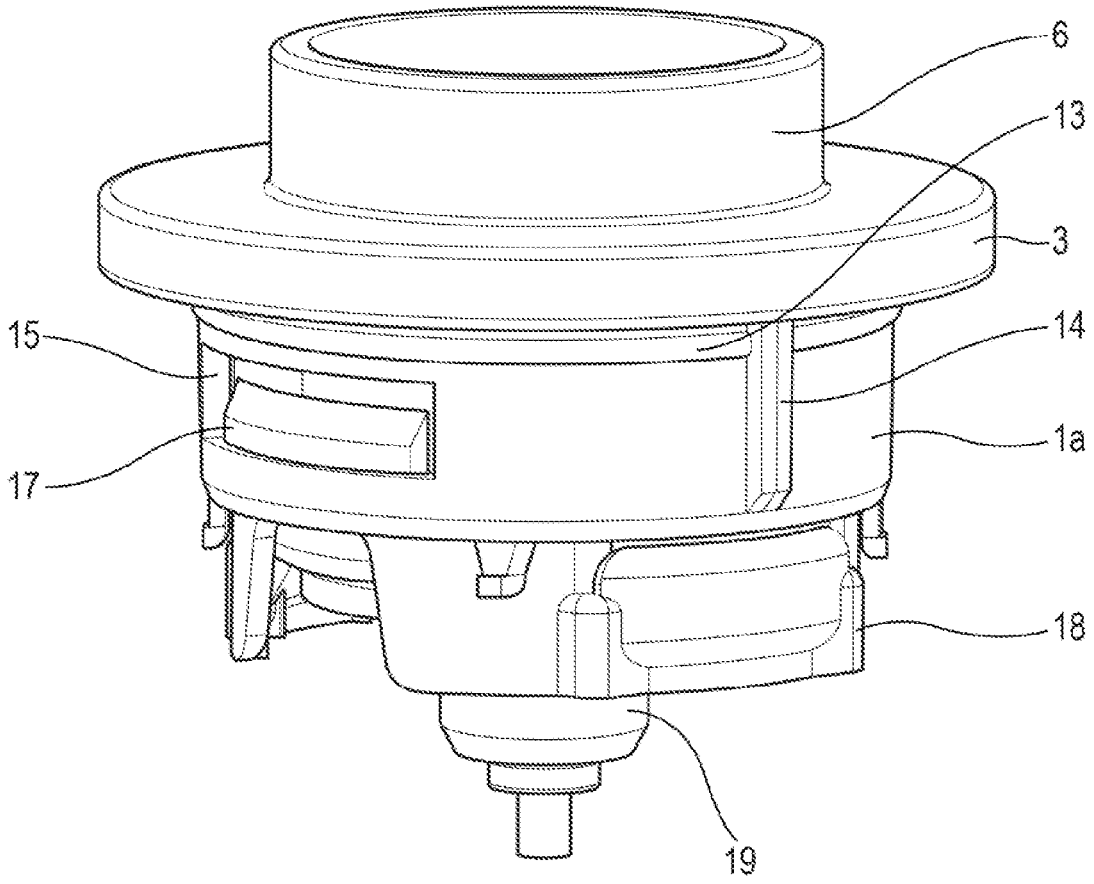

[Fig.15]
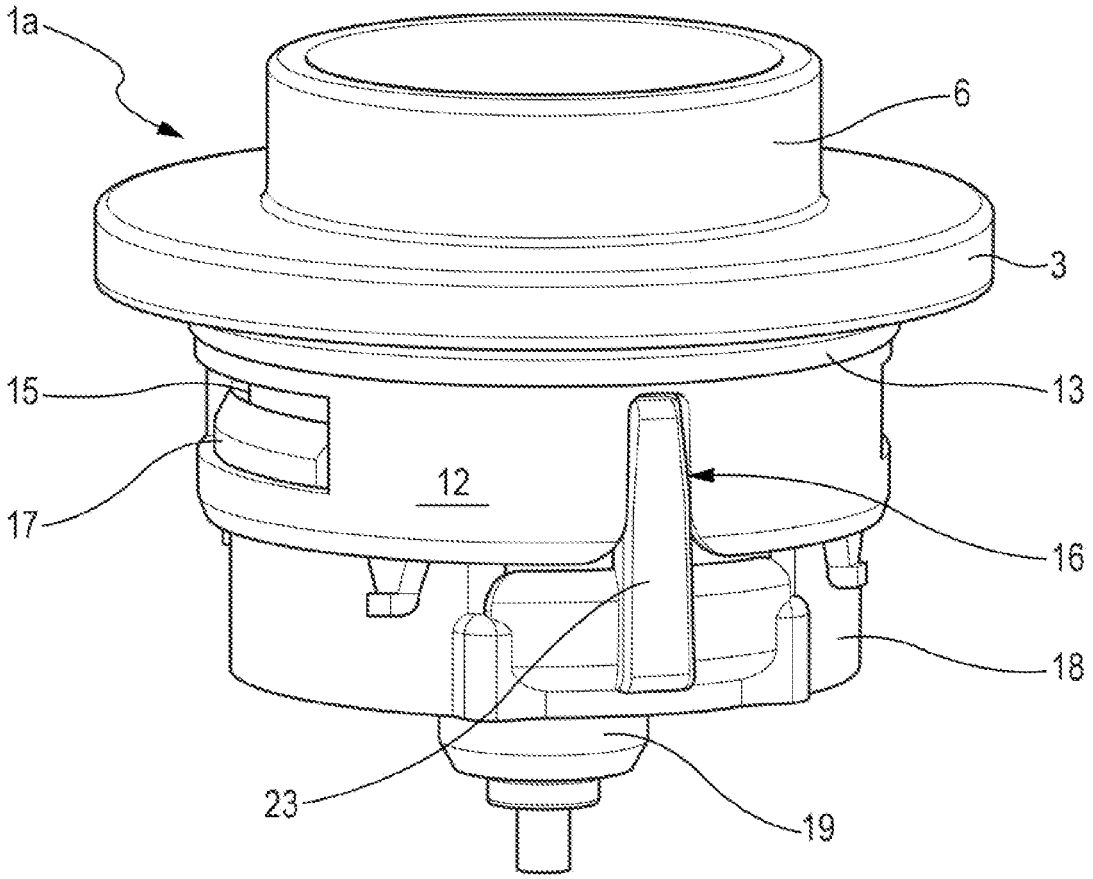

[Fig.16]
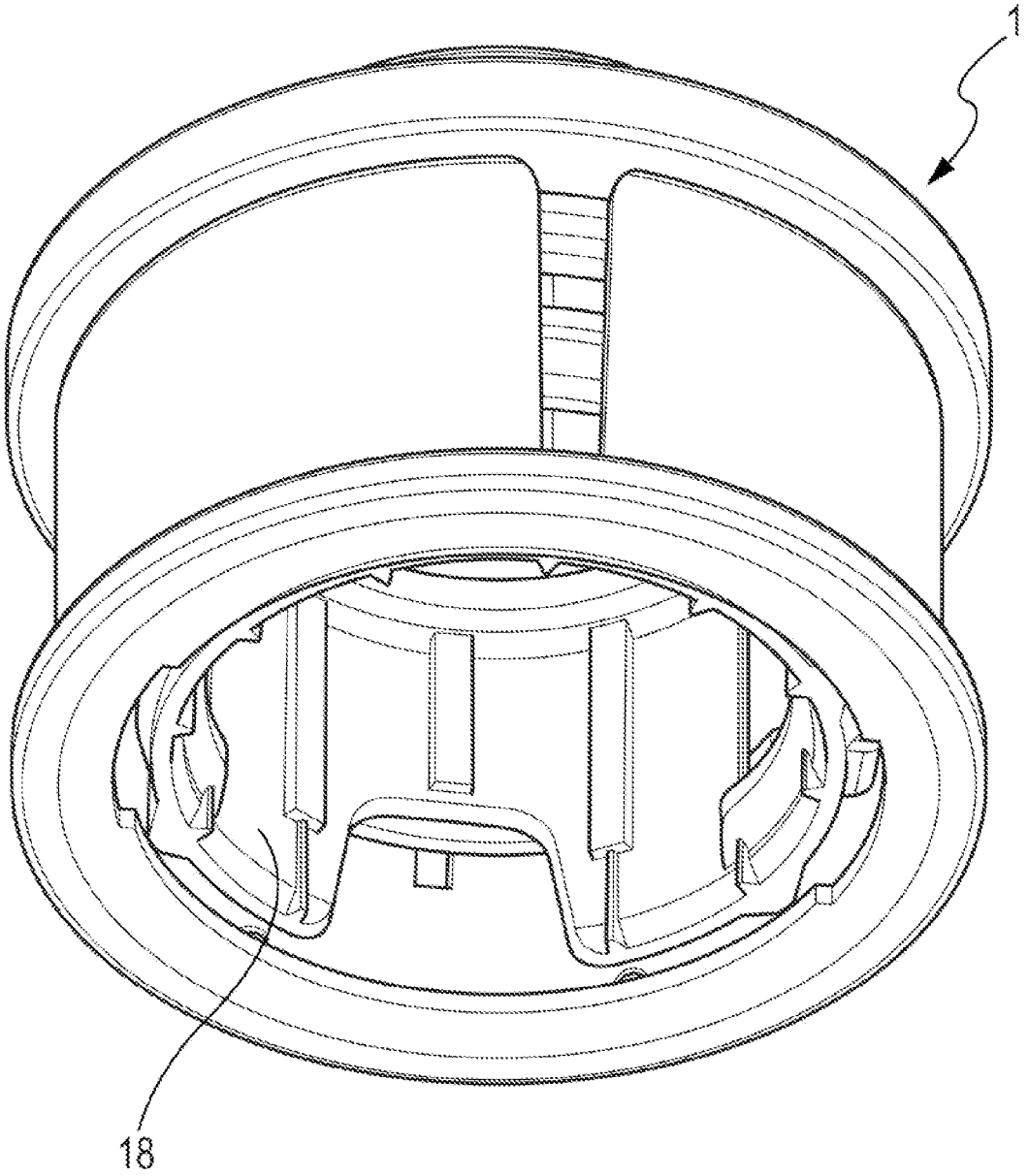

[Fig.17]
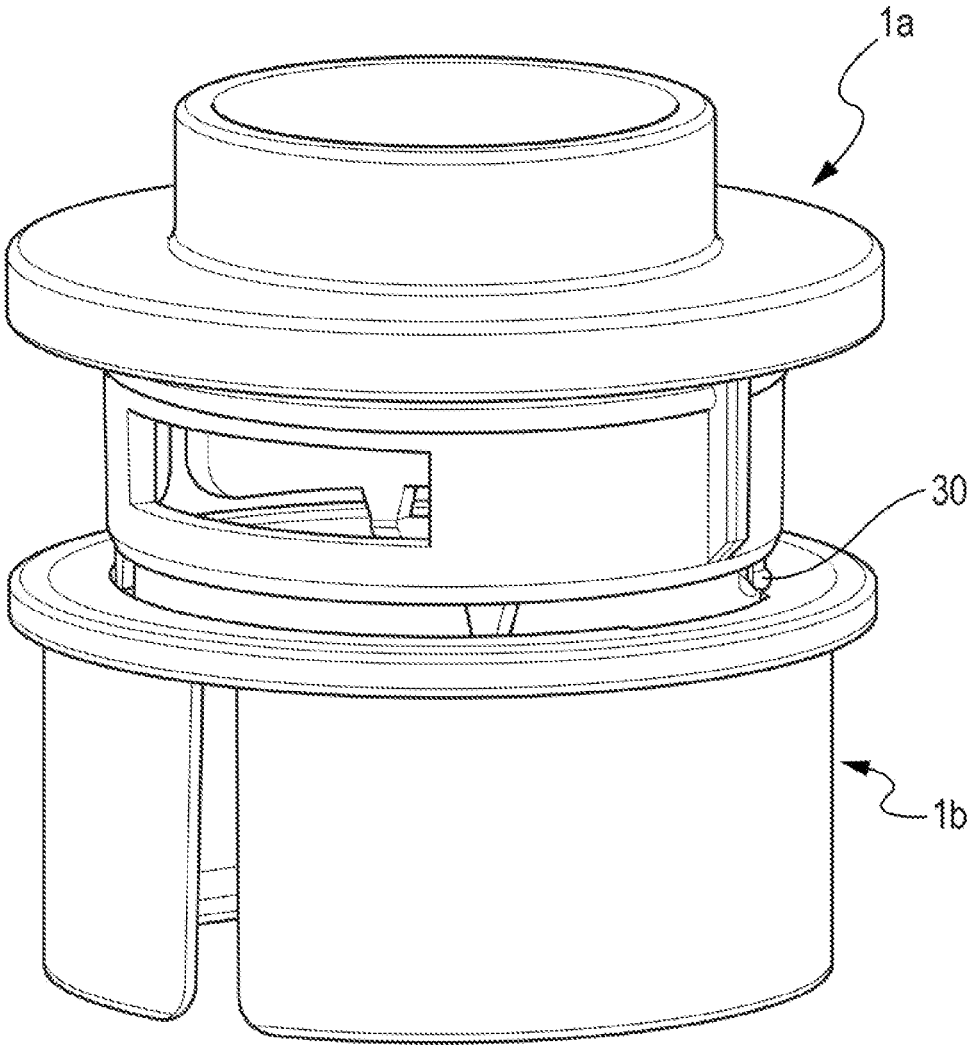

DECORATION DEVICE FOR DISTRIBUTION SYSTEM, AND DISTRIBUTION SYSTEM INCLUDING SUCH A DECORATION DEVICE

CROSS REFERENCE TO RELATED APPLICATIONS

The present application claims the benefit of priority to French Patent Application No. 1911620 filed on Oct. 17, 2019, the disclosure of which is hereby incorporated by reference in its entirety.

BACKGROUND OF THE INVENTION

Field of the Invention

The invention relates to a decoration device for a system for distributing a fluid product such as a cosmetic product like a perfume, an eau de toilette, or a fragrance, and more particularly to a distribution system including such a decoration device including a reservoir with a pump capable of vaporizing the product.

Description of the Related Art

Decorative frets used to hide ungainly distribution means, of the pump type, and/or also to hide the neck of the reservoir are known. Thanks to these frets, the user cannot see the different pump, or valve mechanisms, or other non-aesthetic technical parts.

It is also known to decorate these frets with a strip in order to give them a style which is even more sought. This strip goes around the fret. There are several ways to fix the strip around the fret.

The strip glued on the outer wall of the fret is known. It is difficult to succeed in gluing the ends of the strip edge-to-edge, and there is either a clearance between the ends, or a superposition, on the contrary. In any case, the connection zone between the ends is inaesthetic. To hide it, a decorative bar is, for example, affixed above the connection zone.

Also, the elastic strip is known, mounted on the fret by elastic stretching. The disadvantage is that this type of elastic strip can easily be removed from the fret, and this type of strip is therefore frequently stolen in shops.

The aim of the present invention is to propose a strip which is easily mountable on a fret, and which, once mounted, cannot rotate with respect to the fret, nor be removed from the fret. Another aim of the present invention consists of hiding the ungainly connection zone.

BRIEF SUMMARY OF THE INVENTION

The distribution device according to the invention conventionally includes a sleeve capable of being fixed to a reservoir, distribution means cooperating with the sleeve, and a decoration device surrounding the sleeve and being secured to the sleeve. The decoration device includes a fret capable of being arranged around the neck of a reservoir and capable of hiding the distribution means, the decoration device also including a decorative strip arranged around an outer face of a peripheral wall of the fret.

This distribution device is mainly characterized in that the decoration device includes means for axially blocking the strip with respect to the fret, and in that it includes means for blocking the strip in rotation with respect to the fret, the decoration device having no adhesive means between the strip and the outer face of the peripheral wall.

The main idea of this invention consists of preventing any movement of the strip with respect to the fret, both in axial translation and in rotation. Thanks to this dual blocking, it is not possible to remove the strip from the fret after mounting.

According to the different embodiments of the invention, which can be taken together or separately:

- the strip consists of a wound band having a connection zone from which extend two free ends of the band in the direction from inside the strip: this means that the free ends of the band are not superposed, with a free end inwards and a free end outwards from the strip, but this means that a junction is made in the vicinity of the two free ends, so as to form a circle with the band, and that the two free ends project from this junction to inside the circle.
- the rotational blocking means consist of a slot provided on the fret, into which the connection zone of the strip is inserted: the strip surrounds the fret, and its connection zone is inserted inside the slot and therefore passes inside the fret, such that the user does not see it, or barely sees it. The connection zone, as well as the two free ends of the band are thus hidden inside the fret. Once the connection zone is inserted in the slot, the strip can no longer rotate around the fret, as in case of rotation in a clockwise direction, the connection zone directly abuts against a first lateral side of the slot, and in case of rotation in an anticlockwise direction, the connection zone directly abuts against the second lateral side of the slot.
- the axial blocking means consist of two annular lips extending from the outer face of the wall of the fret and delimiting the axial position of the strip on the fret: the strip is thus positioned between these two lips, and abut against one of the lips in the case of an axial movement in one direction, and abut against the other lip in the case of an axial movement in the other direction.
- the fret includes a lower crown and an upper crown inserted in the lower crown: the fret is this composed of two elements which are interlocked in one another.
- the lower crown includes the slot, as well as one of the annular lips, in this case, a lower annular lip arranged in the vicinity of a lower end of the lower crown.

The outer face of the peripheral wall of the fret corresponds to an outer face of a peripheral wall of the lower crown, the connection zone of the strip is inserted in the slot of the lower crown, and the free ends of the strip are arranged against an inner face of the wall of the lower crown.

- the free ends of the strip are flattened between the inner face of the wall of the lower crown and an outer face of the wall of the upper crown: the free ends of the strip are thus "sandwiched" between the two crowns.
- the lower crown includes, at the level of the inner face of its wall, and on either side of the slot, means for compensating the thickness of the free ends of the strip: indeed, in the absence of these compensation means, the upper crown would thus be off-centred with respect to the lower crown, as the free ends of the strip induce an excess thickness which radially offsets the position of the upper crown with respect to the lower crown. These compensation means therefore make it possible to conserve a coaxial mounting between the two crowns.
- the compensation means consist of two recesses made in the inner face of the wall of the lower crown, on either side of the slot, each recess being provided to receive a free end of the strip, each recess extending over a circular arc at least equal to the length of the corresponding strip, and over a width at least equal to the width of the strip: these two recesses therefore receive the free ends of the strip, such that the thickness of the lower crown at the level of its recesses, added to the thickness of the free ends of the strip, equivalent to the normal thickness of the lower crown outside of its recesses. Consequently, the thickness of the lower crown/free ends assembly of the strip is uniform at any point.

the upper crown and the lower crown have means for snap-fitting into one another: the two crowns are thus firmly secured to one another.

the upper crown and the lower crown have means for indexing one against the other: this is in particular necessary for their engagement with the other parts of the distribution system, such that the location of the indication of the brand directed towards the user is always oriented opposite the slot of the lower crown, therefore diametrically opposite with respect to the connection zone of the strip that the user does not want to see.

the connection zone of the strip is made by a seam, a weld, a knot, or adhesive means: two end sections of the strip are connected to one another by a connector done over the whole width of the strip. In concrete terms, the two band pieces, remaining downstream from the connector correspond to the free ends of the band.

The invention also relates to a system for distributing a fluid product, including a reservoir capable of packaging the fluid product and having a body surmounted by a neck, and a distribution device, such as described above. Advantageously, there are indexing and snap-fitting means between the sleeve and the upper crown. This makes it possible to secure the fret to the distribution means, and to orient the fret with respect to the distribution means, as explained above, so as to position the connector zone and the free ends of the strip opposite the front of the distribution head where the distribution orifices are located, and opposite the front of the reservoir, where the presentation brands of the product are located.

The invention also relates to a decoration device for a system for distributing a fluid product, including a fret capable of being arranged around a neck of a reservoir and capable of hiding distribution means, the decoration device also including a decorative strip arranged around an outer face of a peripheral wall of the fret, the device being characterized in that it includes means for axially blocking the strip with respect to the fret, and in that it includes means for rotationally blocking the strip with respect to the fret, the decoration device having no adhesive means between the strip and the outer face of the peripheral wall, the rotational blocking means consisting of a slot provided on the fret, wherein is inserted a connector zone of the strip.

And finally, the invention relates to a system for distributing a fluid product, including a reservoir capable of packaging the fluid product and having a body surmounted by a neck, distribution means fixed to the reservoir via a sleeve fixed on the neck, and a decoration device such as described above, surrounding the sleeve and being secured to the sleeve.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is a perspective view of the front portion of the decoration device;

FIG. 2 is an exploded and perspective view of the decoration device;

FIG. 3 is a perspective and transversal cross-sectional view along the reference points A-A of FIG. 1;

FIG. 4 is a perspective and axial cross-sectional view along the reference points B-B of FIG. 1;

FIG. 5 is a perspective view of the rear portion of the decoration device;

FIG. 6 is a perspective view of a decorative strip according to the invention; and FIG. 7 is a perspective view of a lower crown of the decoration device;

FIG. 8 is another perspective view of a lower crown of the decoration device;

FIG. 9 is a perspective view of a strip positioned around the lower crown;

FIG. 10 is a perspective view of an upper crown of the decoration device;

FIG. 11 is a perspective view of a fret composed of an upper crown inserted in a lower crown, according to the invention;

FIG. 12 is an exploded, perspective view of a system for distributing a product;

FIG. 13 is a perspective view of a sleeve belonging to the distribution system according to FIG. 12;

FIG. 14 is a perspective view of a sleeve snap-fitted in the upper crown;

FIG. 15 is another perspective view of a sleeve snap-fitted in the upper crown;

FIG. 16 is a perspective view of an assembly composed of a sleeve and a fret according to the invention;

FIG. 17 is a perspective view of a fret after the moulding step.

DETAILED DESCRIPTION OF THE INVENTION

As illustrated in FIG. 1, the decoration device is composed mainly of a fret 1 around which is arranged a decorative strip 2.

This decoration device corresponds to a revolving assembly, of cylindrical appearance.

The fret 1 is a rigid part, while the strip 2 is a flexible part, in a textile material, preferably made of leather, imitation leather (made of polyurethane material) frequently called leatherette or sky.

The strip 2 can be of any colour, with or without decoration.

In FIG. 1, the fret 1 includes an upper annular lip 3 and a lower annular lip 4, which delimits a space wherein the strip 2 is located. When the strip 2 is mounted on the fret 1, as is the case in FIG. 1, the strip 2 can no longer be axially moved upwards, in which case it abuts against the upper annular lip 3, it can no longer be axially moved downwards, in which case it abuts against the lower annular lip 4. There is therefore an axial blockage of the strip 2 with respect to the fret 1.

In the example presented, the fret 1 is composed of two elements, namely an upper crown 1*a* and a lower crown 1*b*, such as represented in FIG. 2. The upper crown 1*a* is slotted and inserted inside the lower crown 1*b*.

The lower crown 1*b* carries the lower annular lip 4 while the upper crown 1*a* carries the upper annular lip 3. It is therefore easy to arrange the strip 2 on the fret 1 between the two lips 3, 4. In this case, the strip 2 is first arranged around the peripheral wall 20 of the lower crown 1*b*, then the upper crown 1*a* is inserted in the lower crown 1*b* and the strip 2 is located, thus included between the two annular lips 3, 4.

FIG. 6 shows more specifically the shape and the design of the strip 2. This strip 2 is composed of a band wound in the shape of a circle, of which the two end sections are joined with one another, over the whole width of the band, and form a connection zone 5, while leaving the free ends 6 projecting to the inside of the circle thus created. The two sections of the band are preferably connected by seam points. It is possible to imagine other types of connector, of the staple, or weld, or knot, or adhesive means type, or other.

No glue is used between the strip 2 and the outer face of the peripheral wall 20.

Downstream from the junction, the free ends 6 extend to the inside of the strip 2 thus created. As a top view, it is perceived that each end section of the band is, in reality, folded in a U-shape, the bottoms 5*a*, 5*b* of the two Us being secured to one another by the connector. The bottoms 5*a*, 5*b* of the two Us correspond to what is called the connector zone 5.

This connector zone 5 is capable of being inserted inside a slot 8 provided on the lower crown 1*b* of the fret 1.

In FIG. 7, this slot 8 cut in the peripheral wall 20 of the lower crown 1*b* can be seen. This slot 8 opens out to the inside and to the outside of the lower crown 1*b*. This slot 8 extends over the whole width of the crown 1*b*, apart from the lower lip 4. The slot 8 is therefore opened through the top, i.e. at the level of the upper end of the crown 1*b*, opposite the lower end where the lower lip 4 is located. The connector zone 5 of the strip 2 is slid inside this slot 8 until abutting against the lower annular lip 4.

In FIG. 9, the strip 2 implemented around the lower crown 1*b* is illustrated, such as explained above. The connector zone 5 is housed in the slot 8, while the free ends 6 are located housed inside the lower crown 1*b*, and are each flattened against the inner face of the peripheral wall 20 of the lower crown 1*b*. In this position, the strip 2 is blocked in rotation with respect to the lower crown 1*b*, and therefore with respect to the fret 1, generally. Indeed, it is no longer possible to make the strip 2 rotate around the outer face of the wall 20 of the lower crown 1*b*, since the connector zone 5 of the strip 2 abuts directly against the side walls forming the slot 8, whether in the clockwise direction or in the anticlockwise direction.

FIG. 8 shows more specifically the inner face of the wall 20 of the lower crown 1*b*. In this figure, it is perceived that there are two recesses 11 in the inner face, on either side of the slot 8. These recesses 11 are used to receive the free ends 6 of the strip 2. They are therefore sized, in width and in length, according to the width and the length of the free ends 6 of the strip 2. In this case, the recesses 11 must be sufficiently large to receive all of the free ends 6. In other words, the free ends 6 must not exceed the recesses 11, not radially nor axially. The depth of the recess 11 corresponds to the thickness of the strip 2. These recesses 11 are designed to compensate for the thickness of the free ends 6 which are deployed inside the lower crown 1*b*. This is particularly important during the implementation of the upper crown 1*a* in the lower crown 1*b*, such that the free ends 6 of the strip 2 do not push the upper crown 1*a* radially, and that the latter is not off-centred, but can be correctly centred on the lower crown 1*b*.

Indeed, the upper crown 1*a* has a peripheral wall 12 which is positioned opposite the peripheral wall 20 of the lower crown 1*b*, as illustrated in FIGS. 3 and 4. The free ends 6 of the strip 2 are thus housed and sandwiched between the inner face of the wall 20 of the lower crown 1*b* and the outer face of the wall 12 of the upper crown 1*a*.

FIG. 5 illustrates the strip 2 implemented around the fret 1, at the level of the connector zone 5. It is perceived that this connector zone 5 is suitable, with an edge-to-edge finishing of the two sections of the band, without any clearance and without any superposition. The connector is hidden in the slot 8, and the free ends 6 of the band are hidden inside the fret 1.

FIG. 10 shows the upper crown 1*a* more specifically. It has an axial projection 14, capable of being inserted inside an axial groove 9 provided for this purpose in the lower crown 1*b*, and can be seen in FIG. 7. The insertion of the projection 14 in the groove 9 makes it possible to index the upper crown 1*a* with respect to the lower crown 1*b* during their mounting. It must be noted that the assembly could be inverted, i.e. that the projection 14 could belong to the lower crown 1*b* while the groove 9 would belong, in this case, to the upper crown 1*a*. Any other type of indexing can be considered in the scope of the present invention.

Moreover, the upper crown 1*a* has an annular snap ring 13 located under the upper lip 3, capable of being inserted inside an annular groove 10 provided for this purpose in the lower crown 1*b*, in the vicinity of the upper end, i.e. opposite the lower annular lip 4 (see FIG. 7). The insertion of the snap ring 13 in the groove 10 allows the two crowns 1*a*, 1*b* to be snap-fitted in one another, so as to lock them in position. It must be noted that the assembly could be inverted, i.e. that the snap ring 13 could belong to the lower crown 1*b* while the groove 10 would belong, in this case, to the upper crown 1*a*. Any other type of locking between the two parts 1*a*, 1*b* can be considered in the scope of the present invention.

FIG. 12 illustrates a system for distributing a fluid product consisting of a cosmetic product, more specifically a perfume, an eau de toilette or also a fragrance.

This distribution system conventionally includes a reservoir 22 capable to store the fluid product. This reservoir 22 is composed of a body 22*a* surmounted by a neck 22*b*. A sleeve 18 is screwed or snap-fitted on the neck 22*b* of the reservoir 22. This sleeve 18 supports means for distributing the product, of the pump 19 or valve type, carrying a distribution head 24 with an outlet orifice. To hide the neck 22*b* of the reservoir 22, the sleeve 18 and the distribution means, the decoration device such as described above is positioned all around. In finishing, a cap 21 for protecting the distribution head is added above the decoration device. Any type of cap 21 can be considered. The upper crown 1*a* includes a central spout 6 of reduced diameter extending outwards from its upper end, and capable of engaging with the protective cap 21.

The sleeve 18, the distribution means, the decoration device and the cap 21 form a subassembly called distribution device.

The decoration device is positioned around the sleeve 18 and is secured to the sleeve 18, so as to be blocked in rotation and axially with respect to the sleeve 18. Thus, when the user takes the fret 1 in their hand, it is possible to unscrew the assembly—fret 1/sleeve 18—with respect to the neck 22*b* of the reservoir 22, so as to dismount the whole distribution system, and have access to the pump 19 or inside the reservoir 22.

FIG. 13 shows more specifically the sleeve 18. This sleeve 18 is a revolving part, of cylindrical appearance, including a peripheral wall, capable of being inserted inside the upper crown 1*a* of the fret 1. The peripheral wall of the sleeve 18 is located thus opposite the inner face of the wall 12 of the upper crown 1*a*. The peripheral wall of the sleeve 18 includes a radial projection 17 projecting outwards from the sleeve 18. This radial projection 17 is capable of penetrating inside a window 15 provided for this purpose in the wall 12 of the upper crown 1*a* of the fret 1 and illustrated, in particular, in FIG. 10. Preferably, the sleeve 18 includes two diametrically opposite radial projections 17, capable of penetrating inside two windows 15 also diametrically opposite, provided on the upper crown 1*a*.

During the introduction of the sleeve 18 in the upper crown 1*a*, the radial projections 17 go back inside the windows 15 thanks to an upper rail so as to snap-fit the sleeve 18 in the upper crown 1*a*, as illustrated in FIG. 14. The two parts 18, 1*a* are thus secured and locked to one another, the radial projection 17 forming a lower shoulder which abuts against the frame of the window 15. It would have also been possible to provide a locking system between the sleeve 18 and the lower crown 1*b*. The aim is to have a locking between the sleeve 18 and the fret 1, generally. FIG. 16 shows the positioning of the sleeve 18 in the fret 1.

In FIG. 15, it can clearly be seen that the sleeve 18 also includes an axial projection 23, capable of penetrating inside a slot 16 provided for this purpose in the peripheral wall 12 of the upper crown 1*a*. The precise positioning of this axial projection 23 inside the slot 16 allows an indexing between the sleeve 18 and the upper crown 1*a*. It would have also been possible to provide an indexing system between the sleeve 18 and the lower crown 1*b*. The aim is to have an indexing between the sleeve 18 and the fret 1, generally. In the present case, the slot 16 of the upper crown 1*a* is located opposite the slot 8 of the lower crown 1*b*, as illustrated in FIG. 11, and the axial projection 23 of the sleeve 18 therefore is supported against the connector zone 5 of the strip 2. The slot 16 thus ensures a dual function, namely that of the passage of the connector of the strip 2.

The indexing between the different parts of the system is important to orient the connector zone 5 of the strip 2 behind the distribution system, i.e. opposite the location of the indication of the brand on the body of the reservoir 22*a* (see FIG. 12). Indeed, when the user takes the reservoir 22 in their hand, it orients the front portion of the distribution system towards them, i.e. the face where the brand of the product to be distributed and the brand of the perfumemaker, for example, is located, and you cannot see in the connector zone 5 which is located opposite, on the rear portion of the distribution system.

FIG. 17 shows the way in which are moulded the upper crown and the lower crown 1*b*. More specifically, the upper crown 1*a* and the lower crown 1*b* are moulded together, in one single part, and fastened to one another via breakable tabs 30. For more ease during moulding and demoulding, the lower crown 1*b* is reversed with respect to its mounting position. To proceed with the mounting of the fret 1, it is sufficient to disconnect the crowns from one another by breaking the tabs, to return the lower crown 1*b* to 180°, and it is thus possible to slide the strip 2 around the lower crown 1*b*, then to snap-fit the upper crown 1*a* in the lower crown 1*b*.

The configurations shown in the figures mentioned are only possible examples, not at all limiting, of the invention which on the contrary includes the embodiment and design variants in the scope of a person skilled in the art.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A distribution device for a system for distributing a fluid product, comprising:

a sleeve capable of being fixed to a reservoir, distribution means cooperating with the sleeve, and a decoration device surrounding the sleeve and being secured to the sleeve, said decoration device comprising a fret capable of being arranged around a neck of a reservoir and capable of hiding the distribution means, said decoration device also comprising a decorative strip arranged around an outer face of a peripheral wall of the fret, wherein the decoration device comprises means for axially blocking the strip with respect to the fret, and in that it comprises means for rotationally blocking the strip with respect to the fret, the decoration device having no adhesive means between the strip and said outer face of the peripheral wall, said rotational blocking means consisting of a slot provided on the fret, wherein is inserted a connector zone of the strip.

2. The distribution device according to claim 1, wherein in the strip comprises a wound band having the connector zone from which extend two free ends of the band in the direction from inside the strip.

3. The distribution device according to claim 1, wherein said axial blocking means comprises two annular lips extending from the outer face of said wall of the fret and delimiting the axial position of the strip on the fret.

4. The distribution device according to claim 1, wherein the fret comprises a lower crown and an upper crown inserted in the lower crown.

5. The distribution device according to claim 4, wherein the lower crown comprises said slot as well as one annular lip, in this case, a lower annular lip arranged in the vicinity of a lower end of the lower crown.

6. The distribution device according to claim 5, wherein the outer face of the peripheral wall of the fret corresponds to an outer face of a peripheral wall of the lower crown, the connector zone of the strip is inserted in the slot of the lower crown, and the free ends of the strip are arranged against an inner face of the wall of the lower crown.

7. The distribution device according to claim 6, wherein the free ends of the strip are flattened between the inner face of the wall of the lower crown and an outer face of the wall of the upper crown.

8. The distribution device according to claim 7, wherein the lower crown comprises, at the level of the inner face of its wall, and on either side of the slot, means for compensating for the thickness of the free ends of the strip.

9. The distribution device according to claim 8, wherein said compensation means consist of two recesses made in the inner face of the wall of the lower crown, on either side of the slot, each recess being provided to receive a free end of the strip, each recess extending over a circular arc at least equal to the length of the free end of the corresponding strip, and over a width at least equal to the width of the strip.

10. The distribution device according to claim 4, wherein the upper crown and the lower crown have means for snap-fitting into one another.

11. The distribution device according to claim 4, wherein the upper crown and the lower crown have means for indexing against one another.

12. The distribution device according to claim 11, wherein said connector zone of the strip is made by a seam, a weld, a knot, or adhesive means.

13. A system for distributing a fluid product, comprising:

a reservoir capable of packaging the fluid product and having a body surmounted by a neck, and a distribution device comprising:

a sleeve capable of being fixed to a reservoir, distribution means cooperating with the sleeve, and a decoration device surrounding the sleeve and being secured to the sleeve, said decoration device comprising a fret capable of being arranged around a neck of a reservoir and capable of hiding the distribution means, said decoration device also comprising a decorative strip arranged around an outer face of a peripheral wall of the fret, wherein the decoration device comprises means for axially blocking the strip with respect to the fret, and in that it comprises means for rotationally blocking the strip with respect to the fret, the decoration device having no adhesive means between the strip and said outer face of the peripheral wall, said rotational blocking means consisting of a slot provided on the fret, wherein is inserted a connector zone of the strip.

14. The system according to claim 13, wherein the fret comprises a lower crown and an upper crown inserted in the lower crown, the system further comprising indexing and snap-fitting means between the sleeve and the upper crown.

15. A decoration device for a system for distributing a fluid product, comprising a fret capable of being arranged around a neck of the reservoir and capable of hiding the distribution means, said decoration device also comprising a decorative strip arranged around an outer face of a peripheral wall of the fret, wherein said device comprises means for axially blocking the strip with respect to the fret, and wherein said device comprises means for rotationally blocking the strip with respect to the fret, the decoration device having no adhesive means between the strip and said outer face of the peripheral wall, said rotational blocking means consisting of a slot provided on the fret, wherein is inserted a connector zone of the strip.

16. A system for distributing a fluid product, comprising a reservoir capable of packaging the fluid product and having a body surmounted by a neck, distribution means fixed to the reservoir via a sleeve fixed on the neck, and a decoration device surrounding the sleeve and being secured to the sleeve, the device comprising a fret capable of being arranged around a neck of the reservoir and capable of hiding the distribution means, said decoration device also comprising a decorative strip arranged around an outer face of a peripheral wall of the fret, wherein said device comprises means for axially blocking the strip with respect to the fret, and wherein said device comprises means for rotationally blocking the strip with respect to the fret, the decoration device having no adhesive means between the strip and said outer face of the peripheral wall, said rotational blocking means consisting of a slot provided on the fret, wherein is inserted a connector zone of the strip.

* * * * *